US005983182A

United States Patent [19]

Moore

[11] Patent Number: 5,983,182

[45] **Date of Patent: *Nov. 9, 1999**

[54] APPARATUS AND METHOD FOR PRODUCING AUDIBLE LABELS IN MULTIPLE LANGUAGES

[76] Inventor: Steven Jerome Moore, 9 Sonoma Rd., Cortlandt Manor, N.Y. 10566

[ * ] Notice: This patent issued on a continued prosecution application filed under 37 CFR 1.53(d), and is subject to the twenty year patent term provisions of 35 U.S.C. 154(a)(2).

[21] Appl. No.: 08/581,893

[22] Filed: Jan. 2, 1996

[51] Int. Cl.[6] ..... G10L 7/08

[52] U.S. Cl. ..... 704/270; 704/3

[58] Field of Search ..... 395/2.1, 2.67, 395/2.69, 2.79, 2.81, 2.85, 2.86; 364/419.01, 419.02, 419.03, 419.07, 419.16; 704/2, 3, 277, 270; 40/906

[56] References Cited

U.S. PATENT DOCUMENTS

| | | | |
|---|---|---|---|
| 4,099,074 | 7/1978 | Maeds et al. | 307/308 |
| 4,689,817 | 8/1987 | Kroon | 704/260 |
| 4,744,050 | 5/1988 | Hirosawa et al. | 364/900 |
| 4,984,177 | 1/1991 | Roundel et al. | 395/2.86 |
| 5,045,327 | 9/1991 | Tarlow et al. | 704/270 |
| 5,384,701 | 1/1995 | Stentiford et al. | 704/3 |
| 5,577,918 | 11/1996 | Crowell | 434/319 |
| 5,852,803 | 12/1998 | Ashby, III et al. | 704/270 |

OTHER PUBLICATIONS

"Merriam–Webster" Merian–Webster Inc., 1997.

*Primary Examiner*—David R. Hudspeth
*Assistant Examiner*—Harold Zintel

[57] ABSTRACT

There is disclosed a computer-based system and method for generating print-based and/or auditory-based language friendly labels. Further disclosed is an article of manufacture comprising voice simulating microchips housed on a standard label, and an apparatus for downloading data correlating to a desired language string onto the voice simulating microchips.

5 Claims, 6 Drawing Sheets

APPARATUS AND METHOD FOR PRODUCING AUDIBLE LABELS IN MULTIPLE LANGUAGES

BACKGROUND OF INVENTION

1. Field of Invention

The present invention relates generally to a computer-based system and method for generating labels for application to bottles, boxes, jars and other containers. In particular, it relates to a computer-based system and method for generating print-based and/or auditory-based language-friendly labels.

2. Brief Description of the Prior Art

For centuries articles of commerce have been labelled to provide a description of the good sold, directions for use, and source of manufacture. At first labeling was performed by simply making physical marks on the actual vessel containing the article of commerce. Later, as knowledge of paper manufacture spread, paper labels were developed upon which writing or print was placed. These labels were applied to the vessel and held affixed by means of glue, nails or other items of affixation.

Labels have always been particularly important in the pharmaceutical art. While it is generally believed that most medicines available prior to the 20th century were relatively non-toxic, many medicines of yesterday were fatally toxic when taken in the wrong dose. For example, in the late 1800's nitroprussic acid, a cyanide-based solution, was not infrequently given to people suffering from menstrual pains, epilepsy and coughs. Numerous deaths were reported in that period owing to inappropriately applied or misunderstood directions on the medicament.

Arguably, however, with the advent of new, stronger and more selective pharmaceutical drugs, labeling has become even more important in the last century. Today a patient may well be exposed to cardioselective drugs such as calcium channel blockers, anti-cancer drugs such as alkylating agents, non-depolarizing neuromuscular blockers such as tubocurarine chloride, and antipsychotic drugs such as amitriptyline, all of which can be lethal if taken in too high of a dose. For example, digoxin, a glycoside derived from the plant *Digitalis lanata*, is not infrequently given to persons suffering from cardiovascular disease. Numerous deaths have been reported in this century owing to inappropriately applied, misunderstood or unread directions placed on this medicament.

In the pharmaceutical art, pharmacists have been given the duty for assuring that therapeutically sound directions are applied to every prescription. Until the widespread advent of personal computer systems nearly 20 years ago, pharmacists depended solely on their retained knowledge of drug dosages, interactions, and routes of administration. After checking for the therapeutic soundness of a prescription, pharmacists generally typed onto a paper label the name of the patient, the name of the physician, the date, the drug name, the directions for use and the number of refills. Today, most pharmacists enter the same drug information into computer-based systems which automatically generate the label. These computer-based systems are often programmed to detect possible drug interactions, and in many cases possible drug overdoses. Rather than typing out each character of the name, drug, direction etc., however, pharmacists today use a system of code identifiers known as "sig codes," that is, letters and symbols which represent words or word strings. For example, the code "1TAC" might be transformed by programming into "Take one capsule three times a day after meals" on the label.

While much has improved in the detection of errors on pharmaceutical labels, one particular problem still plagues the field—the inability of many consumers to read the label. Commercially available pharmacy computer systems produce labels printed in the predominant language of the country in which the system is found. Many newly arrived literate immigrants are unable to read these labels. Furthermore, such labelling does not aid the illiterate, the blind, or sight-impaired.

In a similar manner, most manufacturers of packaged products label their products using the predominant language of the people in the area in which their product is distributed. Labeling size restrictions often prohibit printing the label in more than one language.

Microchip technology has advanced to the point that chips can now convert human voice signals into digitized datastreams. Such digitalized datastreams can be stored, processed and converted back into a voice simulation by means of a voice simulation microcircuit. A wide variety of voice simulating microcircuits are commercially available such as General Dynamics SPO256A, National Semiconductor MM54104, Texas Instrument TMS5220, Mitsubishi M50800-SP, Signetics MEA-8000, OKI Semi-Conductor Inc. MSM6378 (programmable) etc., and includes microprocessors, such as the AIM-65 marketed by Rockwell International having a electrical programmable read only memory (EPROM), coupled to voice synthesizer chips such the Voltrax Speech PAC with SC-01 voice synthesizer chip by Vodex, etc. Heretofore, such voice simulation microcircuits have not been applied in the labeling art.

SUMMARY OF THE INVENTION

It is an object of the present invention to provide for improved labeling of goods.

It is another object of the present invention to provide for language-friendly labeling.

These and other objects are attained in accordance with one aspect of the present invention directed to a processor-based system and method for converting sig codes into a variety of foreign languages. In this embodiment, a pharmacist or technician enters labeling information into a computer pre-programmed to generate labels from the information. The sig codes or code identifiers are electronically-correlated by programming means in a processor-based system to a word or word string written out in full in several languages. A pull-down screen of foreign languages is provided before a label is printed. The pharmacist or technician selects the language in which it is desired to print the label from the plurality of languages displayed on the video display and a datastream representing the selection is used by the processor to select the appropriate database containing data correlating with such language selection. The appropriate data correlating to the sig code is output to a means for printing, the label thus being printed in the selected foreign language.

Another aspect of the present invention is directed to an apparatus for storing the converted sig code information on voice simulating microchips. Such apparatus comprises a data processing means, a memory architecture coupled to said data processing means, said memory architecture correlating a code identifier with a word or word string translated in a plurality of languages, an output video display coupled to said data processing means, a user interface device coupled to said data processing means, a means for printing coupled to said data processing means, and a data processing means instruction set means for displaying a plurality of language options on the output video display upon input of a code identifier into said data processing means, detecting which of the options is selected with the user interface device by the user and directing the data processing means to output a datastream recognizable by said printer means whereby said printer prints said word or word strings in the language chosen. In this embodiment, the voice simulating microchip, which may be affixed to the label, is electronically coupled to the processor-based system. A data stream electronically compatible with the voice simulating microchip, and correlated from the selected database to the entered sig or identifier code entered into the processor, is exported from the processor-based system to the voice simulating microchip memory storage. The digitized information representing the word or wordstrings is converted by the voice-simulating microchip such that when the microchip is activated to output the compatible data stream, human voice simulations in the language chosen are produced.

A further aspect of the present invention is directed to an article of manufacture in which voice simulating microchips are affixed to the labeling information of a product or the container holding the product. Such article of manufacture comprises a label, a means for producing audible sounds affixed to said label, and a means for activating said means for producing audible sounds to produce sound affixed to said label. The voice simulating microchips, which preferentially are of dimensions such that they may easily be affixed to the label, could provide information to the consumer of the product who can not read printed labeling. For example, a microchip might be programmed with the phone number of a poison control center permitting a person who accidentally splashed a caustic into his or her eyes to contact the center. The microchip might further be programmed to emit a series of sounds readily understood by a phone based system as correlating to a series of numbers.

A further aspect of the present invention is directed to an apparatus for providing language-friendly labelling comprising: a data processing means; a memory architecture coupled to said data processing means, said memory architecture correlating a code identifier with a word or word string translated in a plurality of languages; an output video display coupled to said data processing means; a user interface device coupled to said data processing means; a means for printing coupled to said data processing means; data processing means instruction set means for displaying a plurality of language options on the output video display upon input of a code identifier into said data processing means, detecting which of the options is selected with the user interface device by the user and directing the data processing means to output a data stream recognizable by said printer means whereby said printer prints said word or word strings in the language chosen.

A further aspect of the present invention is directed to an article of manufacture in which the voice simulating microchips affixed to the labeling information of a product are programmed to produce voice simulations recognizable as labelling information.

A further aspect of the present invention is directed to an apparatus for providing language-friendly labelling comprising: a data processing means; a memory architecture coupled to said data processing means, said memory architecture correlating a code identifier with a word or word string translated in a plurality of languages; an output video display coupled to said data processing means; an user interface device coupled to said data processing means; a means for printing coupled to said data processing means; data processing means instruction set means for displaying a plurality of language options on the output video display upon input of a code identifier into said data processing means, detecting which of the options is selected with the user interface device by the user and directing the data processing means to output a data stream recognizable by said printer means whereby said printer prints said word or word strings in the language chosen.

Yet a further aspect of the present invention is directed to an article of manufacture in which a plurality of voice simulating microchips programmed to produce voice simulations pertaining to labelling information are programmed to produce such voice simulations in a plurality of languages.

DETAILED DESCRIPTION OF THE INVENTION

Figure 1:
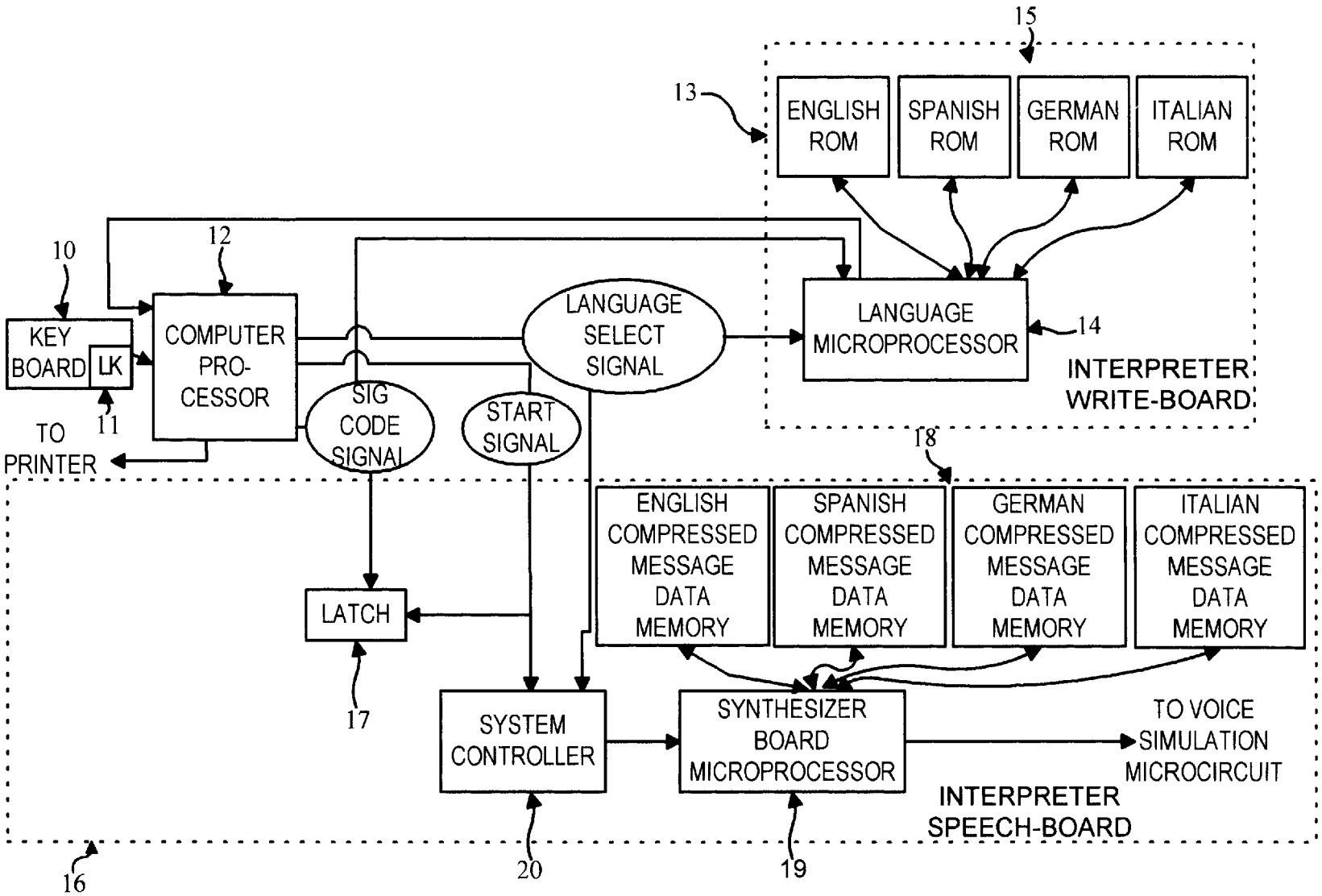
FIG. 1 is a block diagram of a processor-based system permitting selection of language libraries for purposes of outputting a digital data stream corresponding to select words in the selected foreign language to a printer means and/or voice-simulation microprocessor storage means.

Referring to FIG. 1 of the drawings, the components of an embodiment of the present invention are illustrated in block diagram format. As seen, there is provided a processor-based system permitting selection of language libraries for purposes of outputting a digital data stream corresponding to select words in the selected foreign language to a printer means and/or voice-simulation microprocessor storage means. As shown, keyboard 10, or other data input means is connected to a data processing means, computer processor 12. Depression of language key ("LK") 11 results in a signal being sent to computer processor 12 which by programming means prompts for language selection among a number of select languages of a menu set. The language select signal is sent to a language processing means, such as language microprocessor 14 on interpreter write-board 13. Language microprocessor 14 determines from the language select signal which language database, or language read only memory (ROM) 15 functional groups, to access. Language microprocessor 14 then determines which code identifier, or sig code, has been input and correlates the sig code data stream signal with the appropriate language datastream in the selected language ROM 15 sending such language datastream for processing by computer processor 12 and subsequent hardcopy printing by a printing means. The language select signal and sig code signal are further transmitted to interpreter speech-board 16 for subsequent processing of the signals such that a voice stimulation data stream can be output to a voice simulation microcircuit. Interpreter speech-board 16 circuitry conforms to a conventional message synthesizer circuit. The message code signal, in this case a sig code, for specifying a message is entered and after input of a start signal is latched by latch circuit 17. System controller 29, which is provided by an appropriately programmed microprocessor type device such as that described in U.S. Pat. No. 4,074,355, transmits the latched sig code and language select signal to synthesizer board microprocessor 19. Synthesizer board microprocessor 19 is interconnected with language compressed message data memories 18, such as read-only-memories. Compression may be any means known in the art, as for example ADPCM (Adaptive Differential Pulse Code Modulation) or DPCM (Differential Pulse Code Modulation). The compressed message data specified by the message code signal, in this case sig code, is read out from the specified address of the appropriate compressed message data memory 18 by synthesizer board microprocessor 19. The compressed message data which has been read out is expanded and decoded by synthesizer board microprocessor 19 and transmitted in expanded form to the memory of a speech synthesis chip, or in the alternative is transmitted intact to the memory of a speech synthesis chip, thereafter being decoded by a compressed message data decoder.

Figure 2:
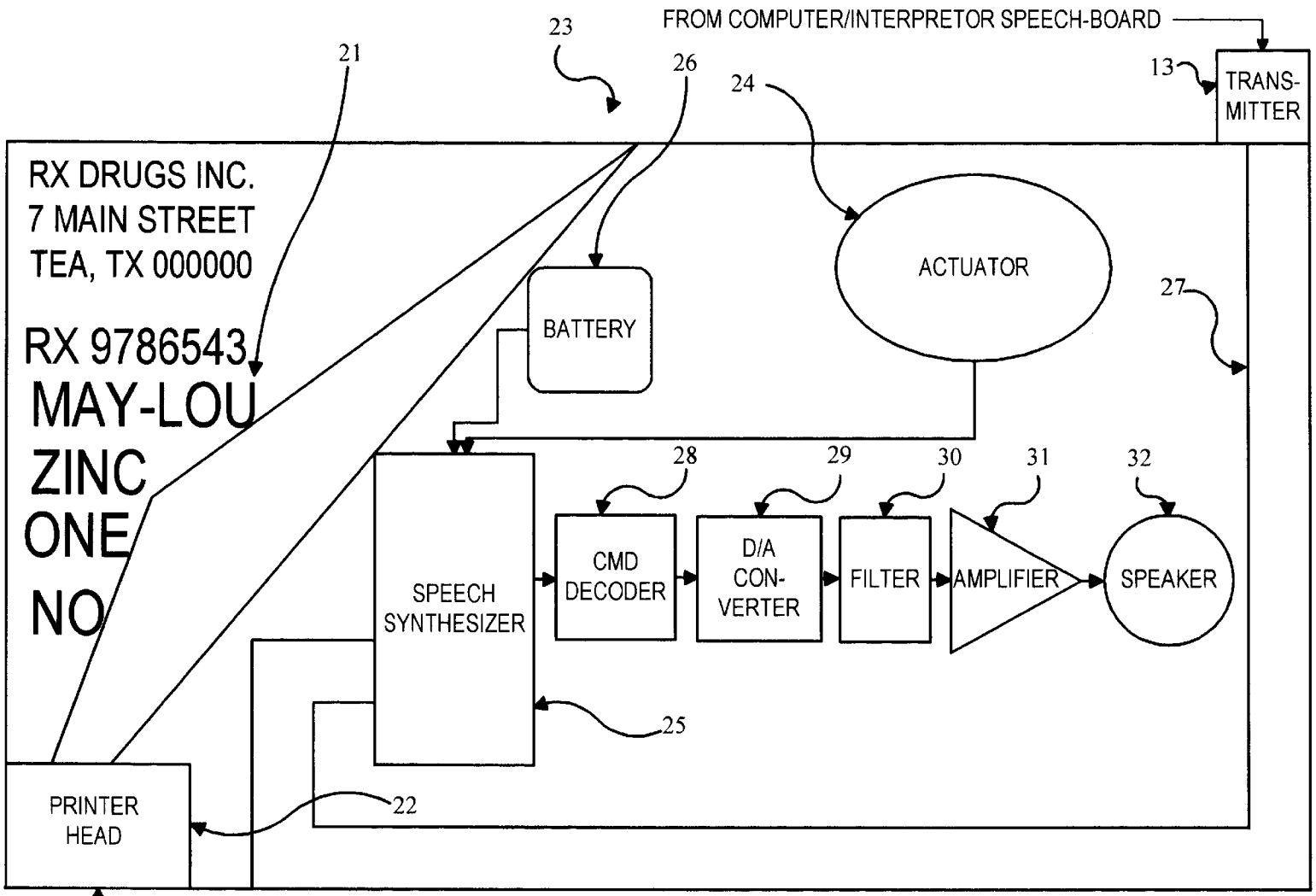
FIG. 2 is a topical cross-sectional view of an article of manufacture comprising a label housing voice-simulation microcircuitry.

As seen in FIG. 2 of the drawings, the digital data stream corresponding to audio output may be input into a voice-simulation chip housed within/on a label 23 upon which print 21 may be added as by means of printer head 22. Transmitter means 13 is electrically coupled to a conductive band 27 in/on label 21. Such conductive band 24 acts as a conduit means for transferring signal, originating from computer/interpreter speech-board 16, from transmitter 13 to speech synthesizer 25. Speech synthesizer 25 stores message data in a specified address of a data memory means. Speech synthesizer 25 is coupled to a power source, such as battery 26, and an actuator device 24 which activates the synthesizer. Actuation of actuator device 24 causes the stored message data to be read out by the synthesizer from the data memory. The compressed message data which has been read out is expanded and decoded by compressed message data decoder (CMD decoder) 28 and after conversion into an analog signal by digital-to-analog converter (D/A converter) 29 passes through message demodulating filter or low pass filter 30 to emit a synthesized message for obtaining a specific message by means of amplifier 31 and speaker 32.

Figure 3:
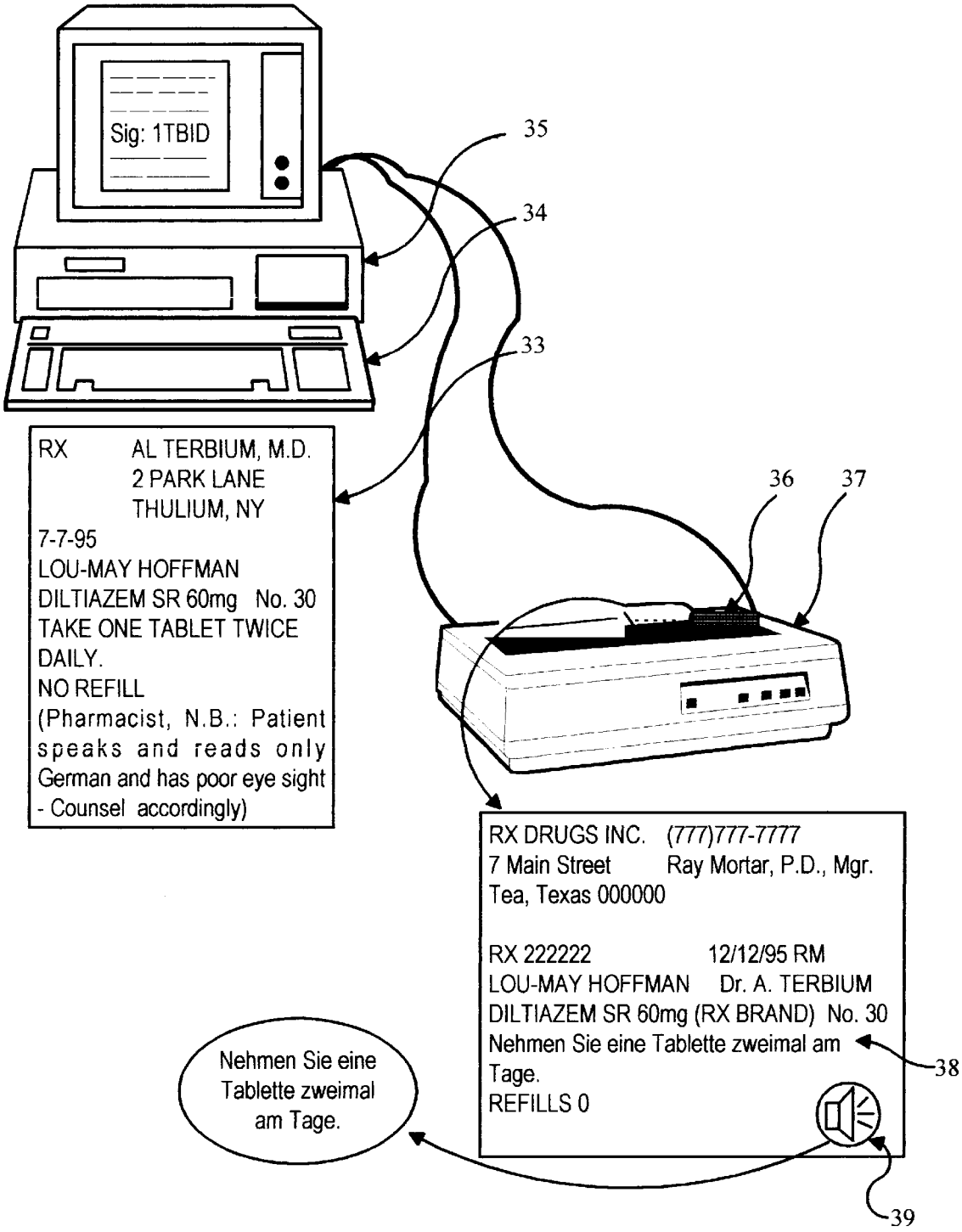
FIG. 3 is a schematic illustration of an systems embodiment of the invention for outputting a data stream from a central processing unit to a voice-simulation microchip housed in/on a label.

Now referring to FIG. 3, there is shown a schematic illustration of a systems embodiment of the invention for outputting a data stream from a central processing unit to a voice-simulation microchip housed in/on a label. As is illustrated, prescription 33 is inputted into computer 35 by way of input means 34. Directions for use of the prescribed drug are input as "sig codes", that is a code identifier which represents a word or string of words. The "sig code" is translated into the language chosen by the circuitry on interpreter write-board 13 and interpreter speech-board 16 into a digital representation of the word or word string represented by the sig code. Output from interpreter write-board 13 is sent to printer 37 such that a printed word or word string in the language chosen 38 will be printed by printer head 22. Output from interpreter speech-board 16 is sent to transmitter 36 which extends such that it makes electrical contact with conductive band 27 thereby storing a message in speech synthesizer 25. Actuation of actuator 24 causes production of oral relay of the message stored in speech synthesizer 25. The location of actuator 24 on/in the label may be demarcated on the label by printed demarcation means 39.

Figure 4:
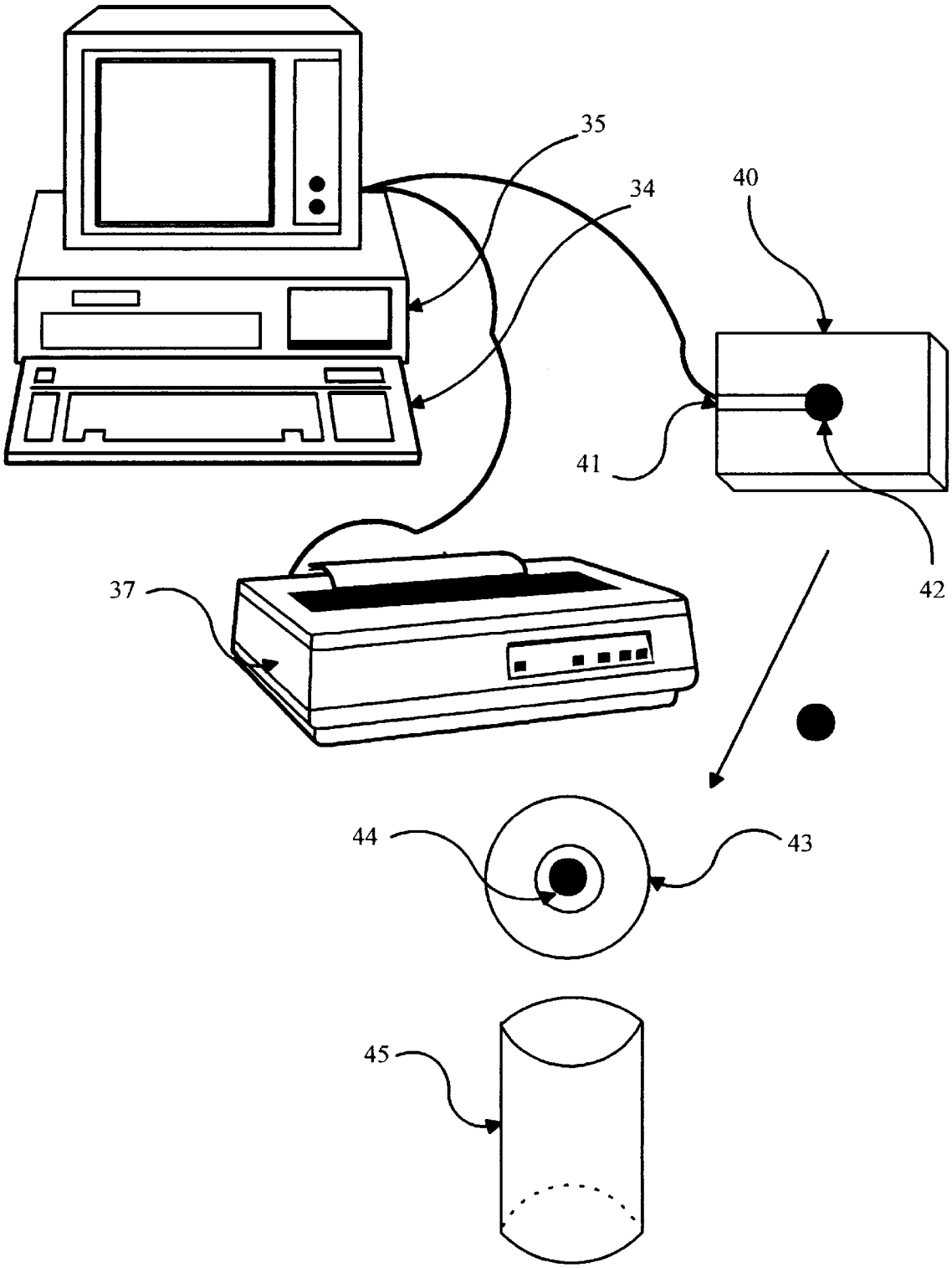
FIG. 4 is a schematic illustration of an systems embodiment of the invention for outputting a data stream from a central processing unit to a voice-simulation microchip which is housable in a product container.

As illustrated in FIG. 4, the above described system and method may be utilized to generate language-friendly voice-simulation microchips that are housable in a recess of a product container. As in the embodiment described in FIG. 3, prescription 33 is inputted into computer 35 by way of input means 34. As before, the "sig code" is translated into the language chosen by the circuitry on interpreter write-board 13 and interpreter speech-board 16 into a digital representation of the word or word string represented by the sig code. Output from interpreter write-board 13 is sent to printer 37 such that a printed word or word string in the language chosen 38 will be printed by printer head 22. In this embodiment, however, output from interpreter speech-board 16 is sent to a conductive means 41 on platform 40 electrically coupled to voice synthesis microcircuitry disk 42. Disk 42 as a unit may be placed in any type of housing desired, including the housing of medicament bottle 45. As shown, medicament bottle 45 has a recess 44 in housing cap 43, preferably a recess which has a covering means such that disk 42 remains securely in housing cap 43.

Figure 5:
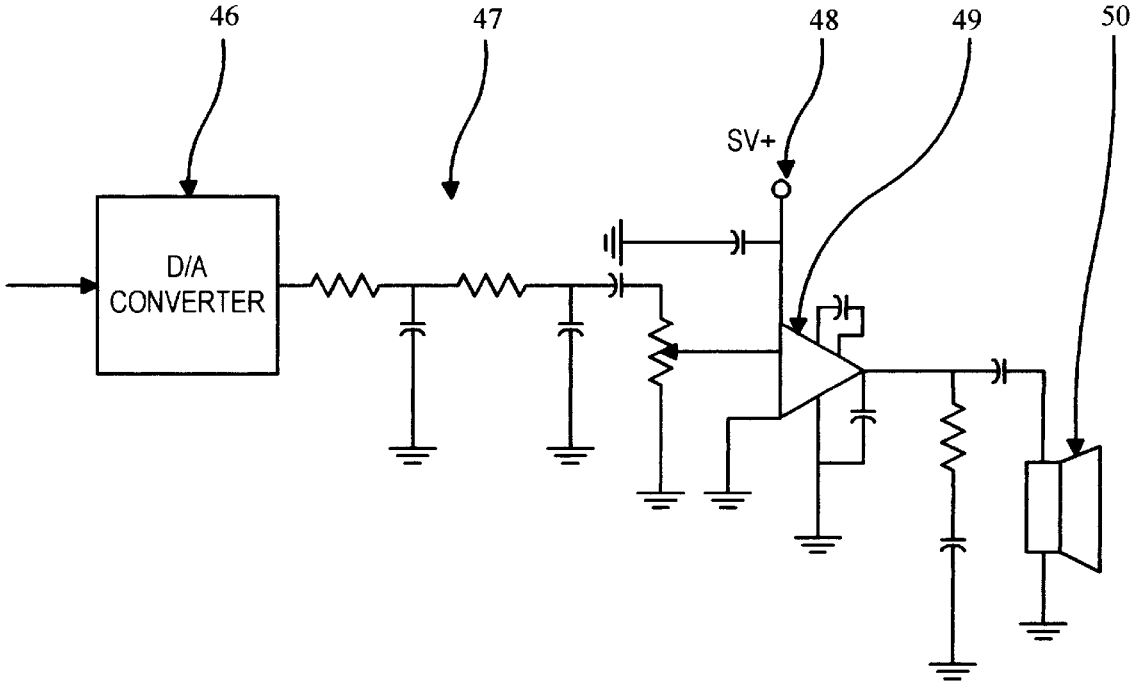
FIG. 5 is a schematic of a audio amplifier and filtering system of an embodiment of the present invention.

Now referring to FIG. 5, there is shown a schematic of audio amplifier and filtering system of an embodiment of the present invention. As shown, digital-to-analog converter 46 is coupled through a plurality of RC filters 47 to audio amplifier 49. Audio amplifier 49 is coupled to a voltage source 48. The output of audio amplifier 49 is coupled to audio speaker 50.

Figure 6:
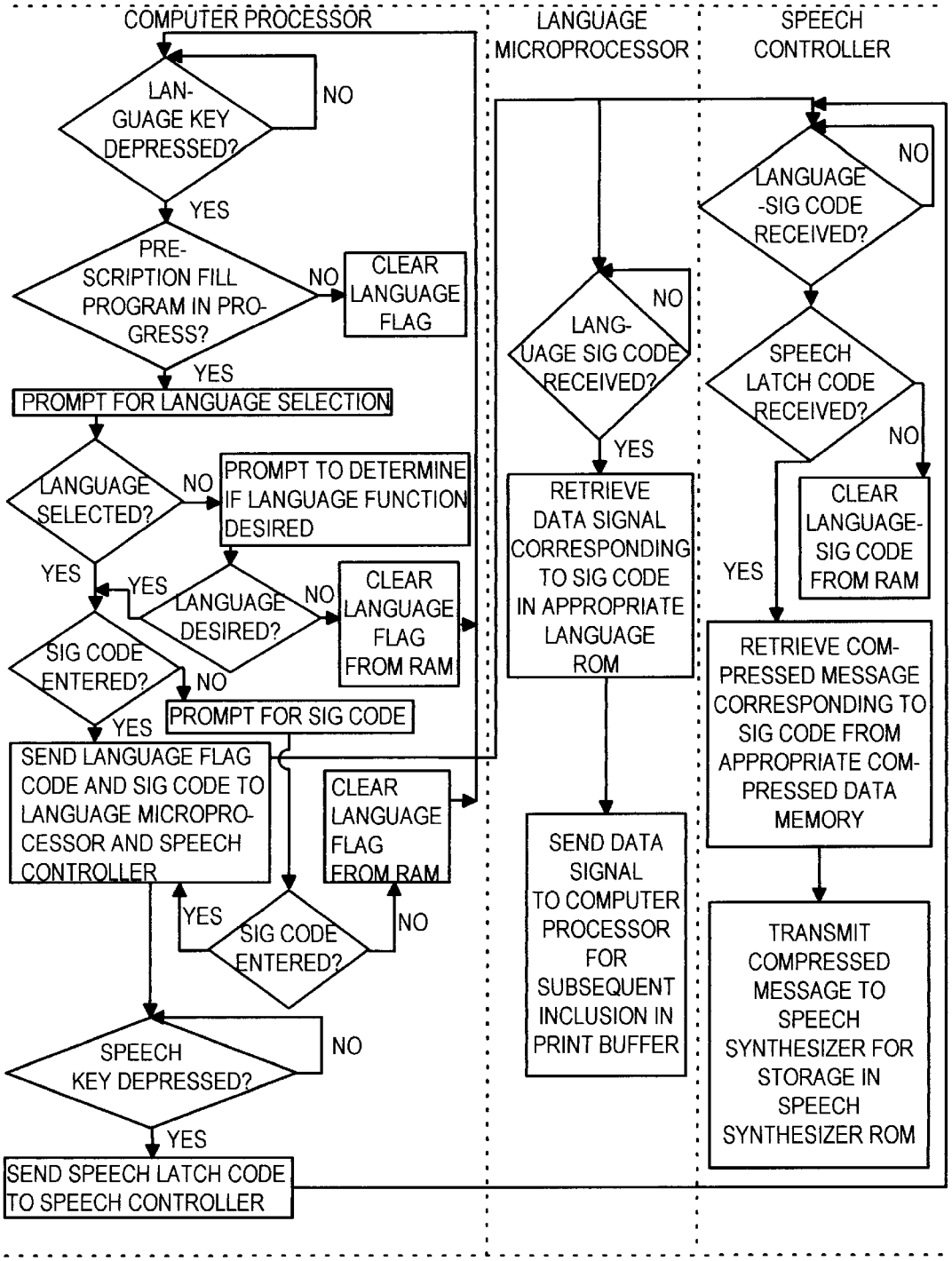
FIG. 6 is a flow chart of an operational routine utilizable in the present invention.

And referring to FIG. 6, there is shown a flow chart of an operational routine utilizable in the present invention. As can be seen, language microprocessor 14 on interpreter write-board 13 requires both a language selection signal input and sig-code signal input for outputting data corresponding to the sig code from the appropriate language ROM 15. Likewise, speech system controller 20 of interpreter speech-board 16 requires both signal inputs as well as an speech latch signal in order to output data corresponding to the sig code which is convertible by the speech synthesis circuitry into sound.

It would be appreciated by one skilled in the art that the specification and drawings depict but a few of the embodiments within the spirit of the invention. Other changes and modifications may be made, as would be apparent to those skilled in the art, without departing from the spirit and scope of the invention.

What is claimed is:

1. A system for providing language-friendly voice simulation microchips comprising:

a data processor;

a memory architecture operatively coupled to said data processor which correlates a letter, symbol or code with a digital data stream representation of a word or word string translated in a plurality of languages;

a video display electronically coupled to said data processor;

an user interface device electronically coupled to said data processor allowing input of said letter, symbol or code, menu selection, and other data into said data processor;

one or more sound simulation microchips electronically coupled to said data processor, said microchips having a sound simulation memory permitting the storage of said digital data stream representation of said word or word string stored in said memory architecture;

a sound generator, capable of producing audible sounds upon receipt of an electronic signal, operatively connected to said one or more microchips;

an actuator operatively connected to said one or more sound simulation microchips and said sound generator causing upon actuation said digital data stream to be output from said voice simulation memory to said sound generator in such a manner that upon actuation of said sound simulation microchips said word or word string corresponding to said digital data stream is audibly produced;

a program instruction set operatively connected to said data processor causing said display to display a menu of a plurality of language options on said video display;

a data processing program instruction set causing said data processor to detect which of said language options displayed on said output video display is selected with said user interface device, to determine the letter, symbol or code input by way of said user interface device, to determine the word or word string correlated in said memory architecture means with said input letter, symbol or code and language option choice and to direct said data processor to output from said memory architecture a digital data stream corresponding with said word or word string translated in said language option into said sound simulation memory of said sound simulation microchips.

2. The system of claim 1 wherein said sound simulation microchip is a sound simulation microprocessor.

3. A computer-based method for providing printed labels tailored to the language proficiency of the persons to which the label is to be directed utilizing a data processing system having a data processor, a memory architecture, a video display, one or more user interface devices, and a printer, said method comprising the steps of:

a. correlating in said memory architecture a letter, symbol or code with a word or word string translated into a plurality of languages;

b. inputting into said data processor by way of said one or more user interface devices said letter, symbol or code;

c. providing a language option menu on said video display to prompt a user to select between a plurality of language options;

d. inputting into said data processor said one or more languages readable by said person(s) to whom said label is to be directed by selecting said languages from said language option menu by means of said one or more user interface devices;

e. detecting by programming means which of said plurality of language options is selected by the user of said user interface device;

f. directing by programming means said data processor to output an electronic data stream recognizable by said printer such that said printer prints said word or word strings in the language chosen onto said label.

4. The method of claim 3 wherein said electronic data stream of step f is directed to a sound simulation microchip.

5. The method of claim 3 wherein said electronic data stream is stored in a memory storage device operatively connected to said sound simulation microchip.

* * * * *